US007867009B2

(12) United States Patent
Hsu

(10) Patent No.: US 7,867,009 B2
(45) Date of Patent: Jan. 11, 2011

(54) SOCKET WITH PLUG RETENTION STRUCTURE

(75) Inventor: Jung-Hui Hsu, Sinjhuang (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 12/732,744

(22) Filed: Mar. 26, 2010

(65) Prior Publication Data

US 2010/0255708 A1 Oct. 7, 2010

(30) Foreign Application Priority Data

Apr. 1, 2009 (TW) ..... 98110805 A

(51) Int. Cl.
*H01R 13/627* (2006.01)

(52) U.S. Cl. ..... 439/353

(58) Field of Classification Search ..... 439/353
See application file for complete search history.

(56) References Cited

U.S. PATENT DOCUMENTS 6,935,878 B2 * 8/2005 Hsu et al. ..... 439/171
7,063,563 B1 * 6/2006 Hsu ..... 439/527

* cited by examiner

*Primary Examiner*—Javaid Nasri
(74) *Attorney, Agent, or Firm*—Kile Goekjian Reed & McManus PLLC

(57) ABSTRACT

A socket with a plug retention structure which includes an upper housing, a lower housing, at least two flexible pieces, and a control unit. The lower housing includes at least two insertion holes. The interior of the lower housing defines an accommodating space. Two flexible pieces are placed in the accommodating space associated with the lower housing. Each of the two flexible pieces has a fulcrum and at least one flexible plate. One end of the flexible plate is connected to the fulcrum, and the other end of the flexible plate forms an abutting portion. The abutting portions of the two flexible pieces correspond to the two insertion holes. The control unit is movably placed in the accommodating space associated with the upper housing. The control unit is configured to selectively press the flexible plates.

8 Claims, 8 Drawing Sheets

SOCKET WITH PLUG RETENTION STRUCTURE

BACKGROUND OF THE INVENTION

1. Field of the Invention

The present invention relates to a socket, and more particularly to a socket with a plug retention structure for locking a plug.

2. Description of Related Art

Sockets are often used to electrically connect power sources with various electronic appliances. With the widespread use of electronic appliances, sockets are used more and more frequently. To avoid the plugs of the electronic appliances from dropping off, many sockets are equipped with plug retention structure. Generally, these sockets utilize a mechanical means to engage the plug retention structure with holes of insertion pieces of the plugs in order to address the problem of the detachment.

A conventional socket with a plug retention structure is shown in FIGS. 11 and 12. The socket includes a casing 1*a*, internal electrodes 2*a*, and locking clips 3*a*. The casing 1*a* further includes an upper shell and a lower shell screwed to the upper shell. In one implementation, the locking clips 3*a* include two pieces for clamping the plug tightly. Each piece of the locking clips 3*a* further includes an insertion opening having a locking protrusion and a locking hole. The socket further includes a clip control switch 4*a* besides the locking clips 3*a*. The clip control switch 4*a* includes an adjusting rod 41*a*, a flexible element 42*a*, a fixing base 43*a*, and a button lip 44*a*. When perforated insertion pieces of the plug are inserted into the socket, the locking protrusions of the locking clips 3*a* are configured to pass through the holes of the insertion pieces of the plug. As such, the plug could be in engagement with the socket, minimizing the occurrence of plug detachments.

However, since the above conventional socket may have to utilize a mechanical means (such as the locking protrusions) the plug detachment may not be avoided when the locking protrusions are not positioned into a predetermined location. Further, the cost for manufacturing the socket with the addition of the mechanical means is higher than that of the socket without any presence of the mechanical means.

SUMMARY OF THE INVENTION

In view of the above problems, the objective of the present invention is to provide a socket with a plug retention structure, which is simpler in structure with reduced production cost. Further, the present invention socket is configured to ensure the engagement between the socket and the plug.

To achieve the above-mentioned objective, the present invention provides a socket with a plug retention structure, which includes an upper housing with at least two insertion holes, and a lower housing located below the upper housing. An interior of the lower housing defines an accommodating space, and the upper housing is configured to correspond to the lower housing. The socket further includes at least two flexible pieces in the accommodating space associated with the lower housing. Each of the two flexible pieces has a fulcrum and at least one flexible plate with one end thereof connected to the fulcrum, and the other end thereof forming an abutting portion. The abutting portions correspond to the two insertion holes. The socket further includes a control unit movably located in the accommodating space associated with the upper housing for selectively pressing the flexible plates of the two flexible pieces.

The flexible pieces of the present invention are made of metal, so that when they are inserted into the insertion holes they may not be detaching from the insertion holes without an application of certain amount of forces. With the flexible pieces, the present invention socket requires no locking protrusions, simplifying the entire structure of the socket and reducing the manufacturing cost for the same.

In order to further understand the characteristics and technical contents of the present invention, a description relating thereto will be made with reference to the accompanying drawings. However, the drawings are illustrative only but not used to limit the present invention.

DETAILED DESCRIPTION OF THE PREFERRED EMBODIMENTS

Figure 1:
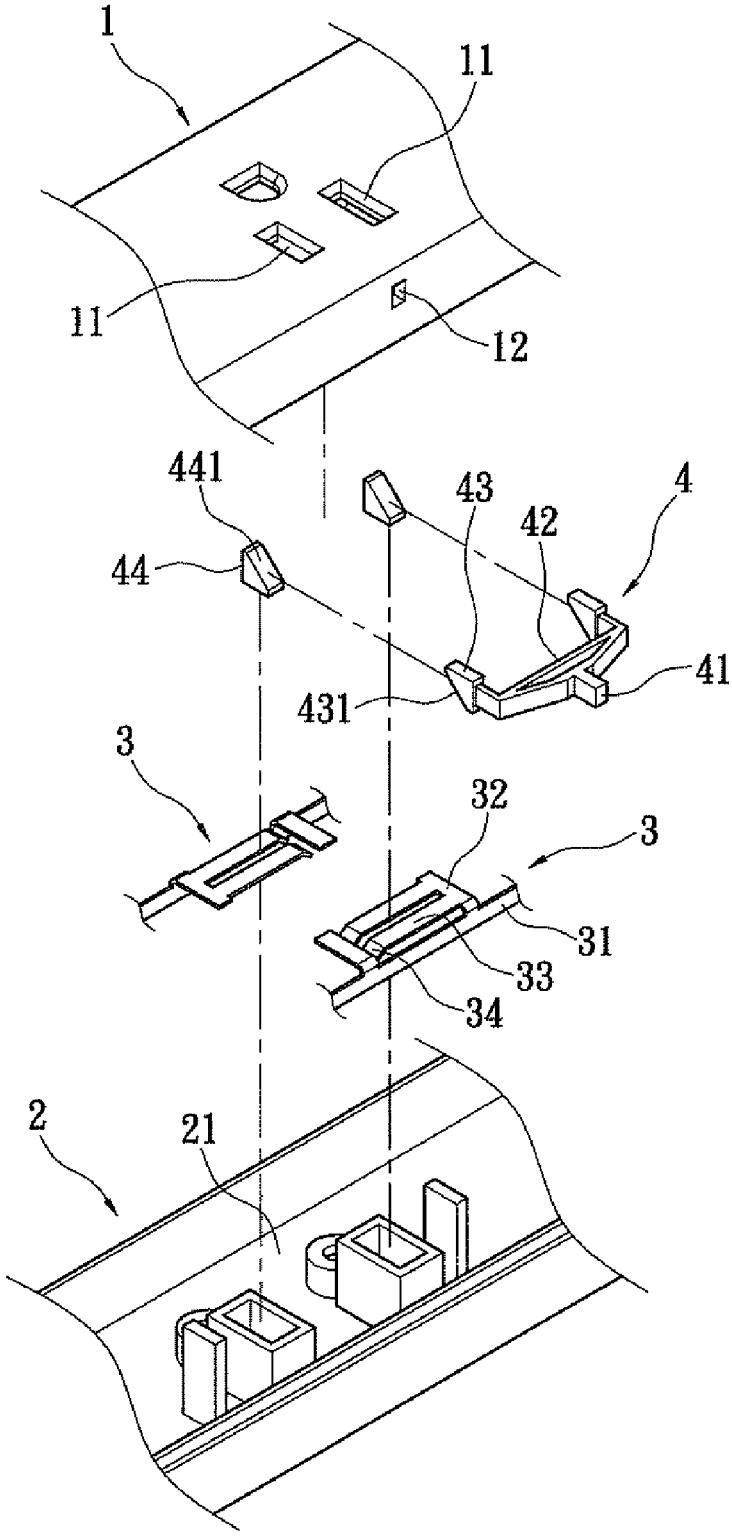
FIG. 1 is an exploded perspective view showing a first embodiment of a socket with a plug retention structure according to the present invention.
Figure 2:
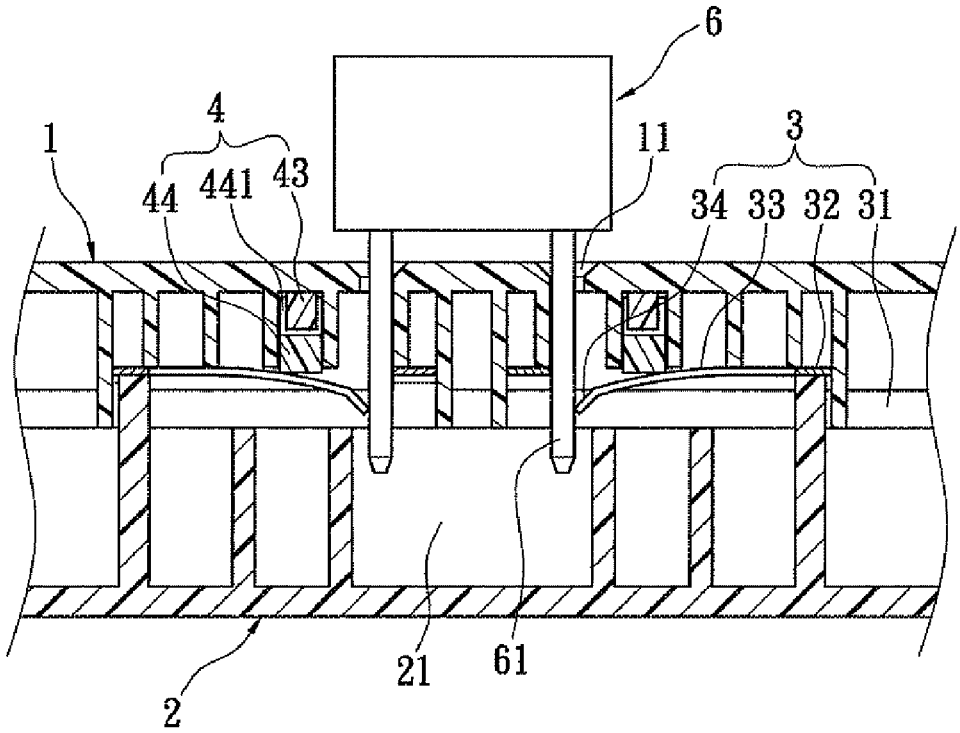
FIG. 2 is a transverse cross-sectional view showing the first embodiment of the socket with a plug retention structure according to the present invention with a plug locked status.
Figure 3:
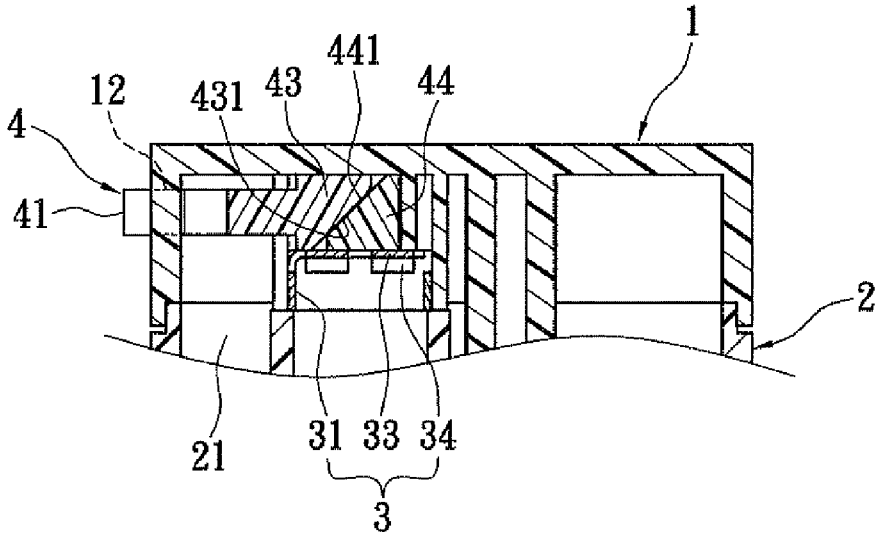
FIG. 3 is a longitudinal cross-sectional view showing the first embodiment of the socket with a plug retention structure according to the present invention with the plug locked status.

Please refer to FIGS. 1 to 3. The present invention provides a socket with a plug retention structure for locking the plug. In one implementation, the plug retention structure includes a locking means corresponding to one set of insertion holes. However, it is worth noting that the number of the locking means may vary according to the number of the sets of the insertion holes.

The socket with a plug retention structure includes an upper housing 1, a lower housing 2, at least two flexible pieces 3, and a control unit 4. The upper housing 1 serves as a cover and includes at least two insertion holes 11 that are of live and neutral polarities respectively. The insertion hole 11 is drilled through a top surface of the upper housing 1. The specification of the insertion hole 11 is not limited to any specific one and may vary to meet different specification requirements. Further, the insertion hole 11 may be equipped with a ground polarity. The upper housing 1 further includes at least one through-hole 12 on its side surface or the top surface. The through-hole 12 is drilled through the side surface or the top surface of the upper housing. In one implementation, the through-hole 12 is provided on the side surface of the upper housing 1.

The lower housing 2 is a hollow casing and is configured to correspond to the upper housing 1. Even so, the lower housing 2 may be configured to satisfy different specifications. The interior of the lower housing 2 defines an accommodating space 21 for accommodating the flexible pieces 3. The top of the accommodating space 21 is an opening for the placement of the upper housing 1. The upper housing 1 and the lower housing 2 can be combined with each other via lodging, screw elements, or supersonic welding.

The flexible pieces 3 is placed in the accommodating space 21 for the placement of the lower housing 2, so that the flexible pieces 3 could be located between the upper housing 1 and the lower housing 2. In one implementation, the two flexible pieces 3 may correspond to the live and neutral insertion holes 11, respectively. The flexible pieces 3 can be a part of conductive pieces of the socket or an independent flexible structure. In one implementation, the flexible pieces 3 are the part of the conductive pieces of the socket, so that the flexible pieces 3 could lock the plug and facilitate an electrical connection. The flexible pieces 3 are made of metallic materials having good electrical conductivity. Each of the flexible pieces 3 is connected to a connecting piece 31 so that the electricity could be delivered from the connecting piece 31 to the flexible pieces 3. Each of the flexible pieces 3 has a fulcrum 32 and at least one flexible plate 33 having one of its end connected to the fulcrum 32. The fulcrum 32 is connected to the connecting piece 31. A portion of the flexible plate 33 is oriented horizontally, and the other portion thereof is bent downwardly. The other end of the flexible plate 33 is formed into an abutting portion 34. The flexible plate 33 and the abutting portion 34 can swing up and down with respect to the fulcrum 32 as a pivot. In normal state, the abutting portion 34 of the flexible pieces 3 is located below the insertion hole 11. The abutting portion 34 is configured to correspond to the insertion hole 11, so that the abutting portions 34 of the two flexible pieces 3 can abut the side edges of the two insertion pieces 61 when the two insertion pieces 61 of the plug 6 are inserted into the two insertion holes 11 of the upper housing 1. Therefore, the plug 6 can be in engagement with the socket.

The control unit 4 can be implemented horizontally or vertically. In one implementation, the control unit 4 is implemented horizontally and includes a button 41, a linkage rod 42, two first linkage blocks 43, and two second linkage blocks 44. The button 41 is connected to the middle portion of the linkage rod 42. The two first linkage blocks 43 are connected to both ends of the linkage rod 42. Each of the lower edges of the two first linkage blocks 43 has a first bevel 431. The button 41, the linkage rod 42, and two first linkage blocks 43 are placed within the accommodating place associated with the upper housing 1 in a manner that they can move horizontally. The button 41 passes through the through-hole 12 of the upper housing 1. One end of the button 41 protrudes from the upper housing 1, so that the users can press the button 41 easily. The two second connecting blocks 44 are provided above the flexible plates 33 of the two flexible pieces 3 for selectively pressing the flexible plates 33. Each of the upper edges of the two second linkage blocks 44 has a second bevel 441. The second bevel 441 and the first bevel 431 are brought into contact with each other correspondingly.

Please refer to FIGS. 2 and 3. When the plug 6 is inserted into the socket, the two insertion pieces 61 of the plug 6 may be inserted into the socket via the insertion holes 11 of the upper housing 1. At the same time, the abutting portions 34 on one ends of the flexible plates 33 of the two flexible pieces 3 can abut the side edges of the two insertion pieces 61. Since the insertion pieces 61 are made of metal, they can be inserted into the insertion holes 11 smoothly while the flexible plates 33 may provide a resistance against a detachment of the insertion pieces 61 from the insertion holes 11. Therefore, the plug 6 could be in secured engagement with the socket.

Figure 4:
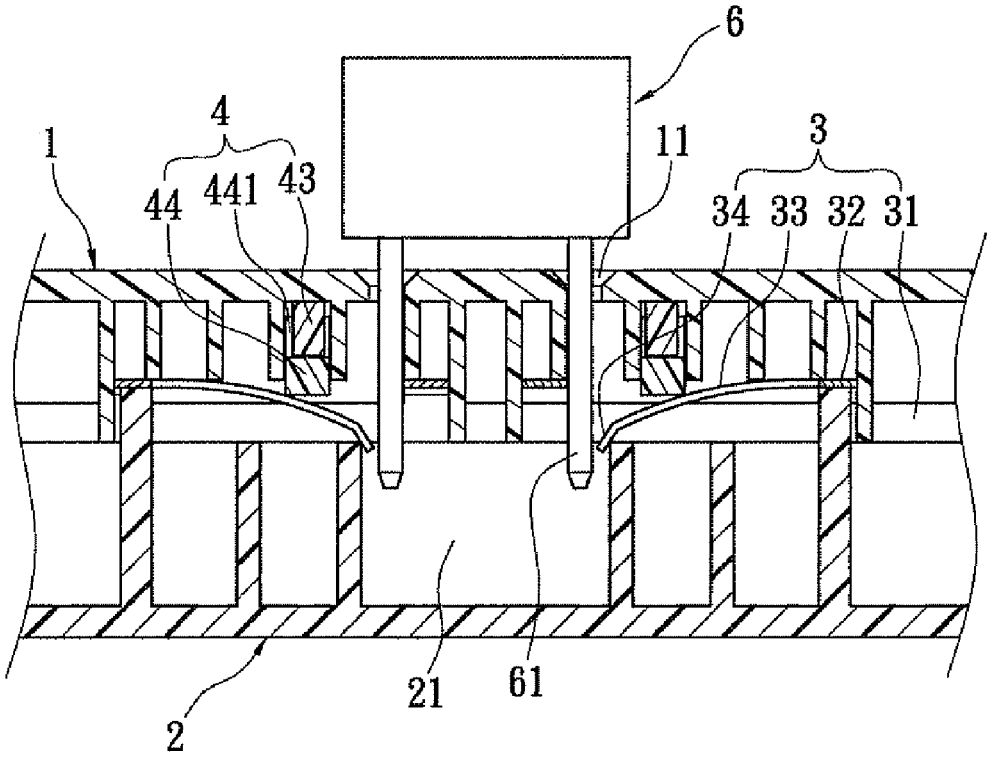
FIG. 4 is a transverse cross-sectional view showing the first embodiment of the socket with a plug retention structure according to the present invention with a plug released status.
Figure 5:
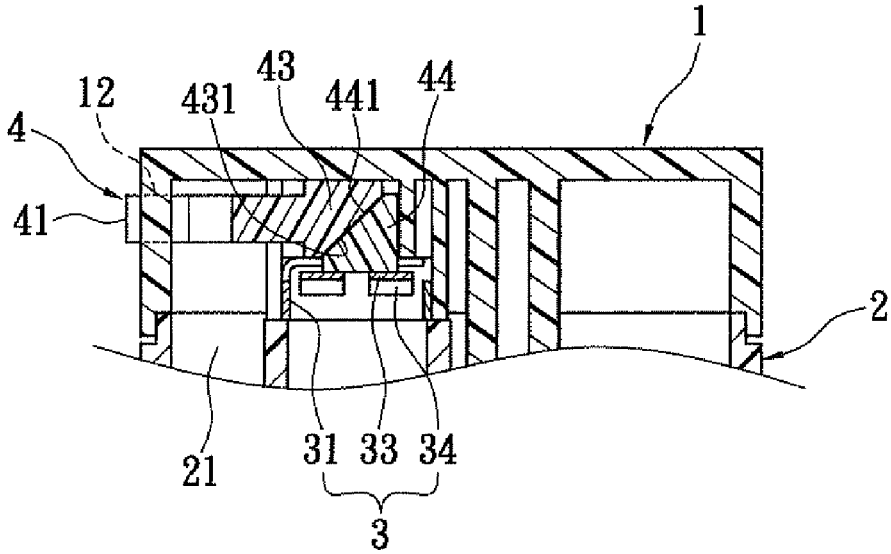
FIG. 5 is a transverse cross-sectional view showing the first embodiment of the socket with a plug retention structure according to the present invention with the plug released status.

Please refer to FIGS. 4 and 5. When the plug 6 is to be removed from the socket, the users can press the button 41 of the control unit 4 in order to make the linkage rod 42 to drive the two first linkage blocks 43 to move horizontally. Via the action between the first bevel 431 and the second bevel 441, the horizontal force can be converted into a vertical force in order to make the two second linkage blocks 44 to press downwards the flexible plates 33 of the two flexible pieces 3. In this way, the abutting portions 34 on one ends of the two flexible pieces 33 can be removed from the two insertion pieces 61 of the plug 6 smoothly, unlocking the plug 6 to facilitate a removal of the plug 6.

Figure 6:
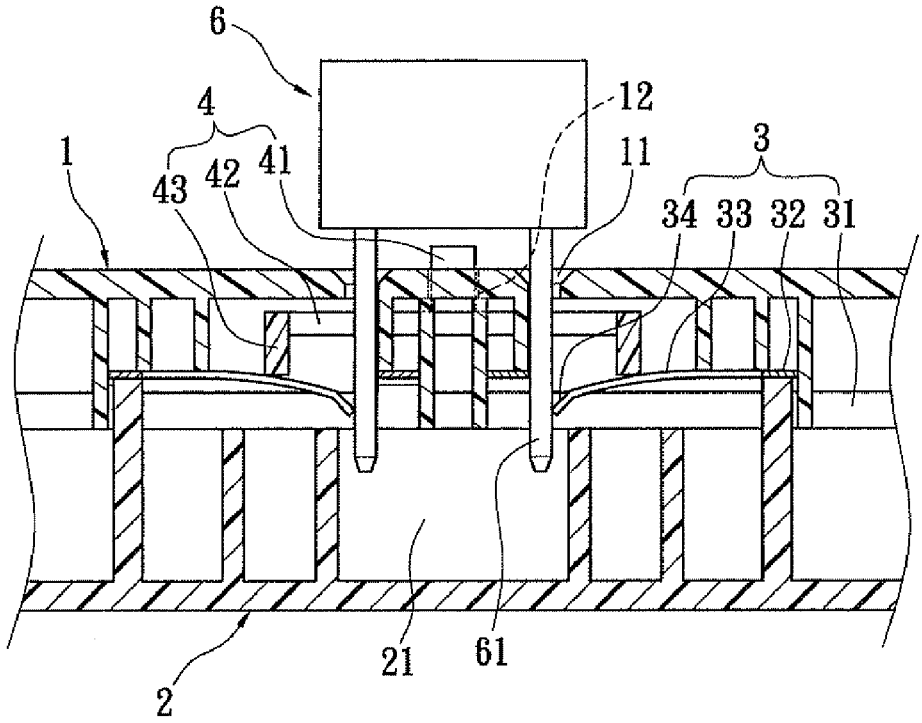
FIG. 6 is a transverse cross-sectional view showing a second embodiment of the socket with a plug retention structure according to the present invention with a plug locked status.
Figure 7:
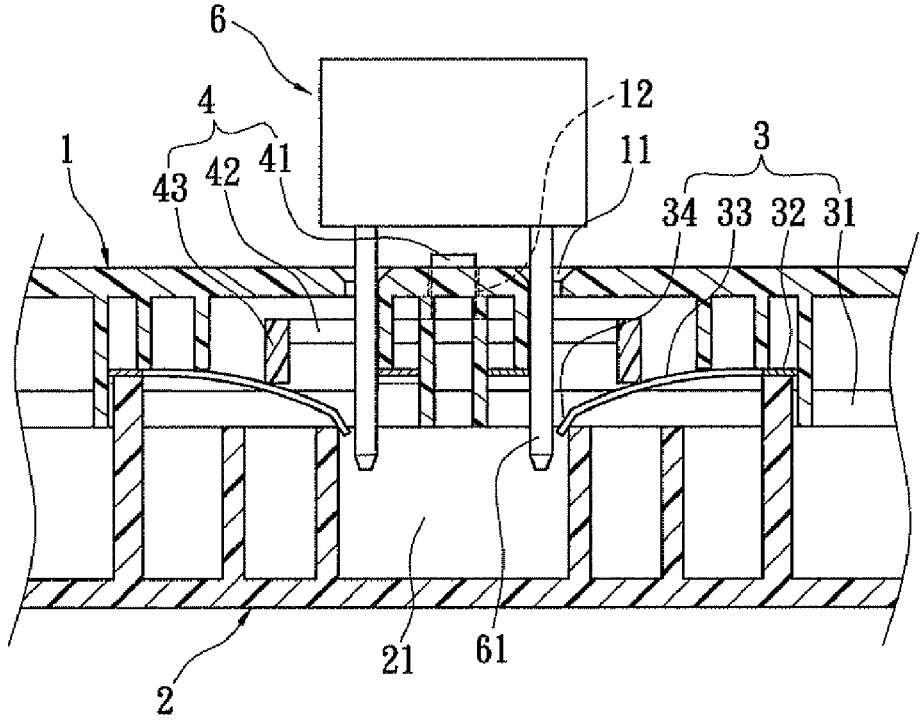
FIG. 7 is a transverse cross-sectional view showing the second embodiment of the socket with a plug retention structure according to the present invention with a plug released status.

Please refer to FIGS. 6 and 7. In one implementation, the control unit 4 is implemented vertically and includes a button 41, a linkage rod 42, and two first linkage blocks 43. The button 41 is connected to the middle portion of the linkage rod 42. The two first linkage blocks 43 are connected to both ends of the linkage rod 42. The button 41, the linkage rod 42, and the two first linkage blocks 43 are placed in the accommodating space within the upper housing 1 in such a manner that they can move up and down. The two first linkage blocks 43 are located above the flexible plates 33 of the two flexible pieces 3 respectively.

Please refer to FIG. 6. When the plug 6 is inserted into the socket, the two insertion pieces 61 of the plug 6 can be inserted into the socket via the insertion holes 11 of the upper housing 1. At this time, the abutting portions 34 on one ends of the flexible plates 33 of the two flexible pieces 3 can abut the side edges of the two insertion pieces 61. Since the insertion pieces are made of metal, they can be inserted into the insertion holes smoothly while the flexible plates 33 may provide a resistance against a detachment of the insertion pieces 61 from the insertion holes 11. Therefore, the plug 6 could be in secured engagement with the socket.

Please refer to FIG. 7. When the plug 6 is to be removed from the socket, the users can press the button 41 of the control unit 4 so as to make the linkage rod 42 to drive the two first linkage blocks 43 to move downwards. With the two first linkage blocks 44 pressing downwards the flexible plates 33 of the two flexible pieces 3, the abutting portions 34 on one ends of the two flexible plates 33 can be removed from the two insertion pieces 61 of the plug 6 smoothly, unlocking the plug 6 to facilitate a removal of the plug 6.

Figure 8:
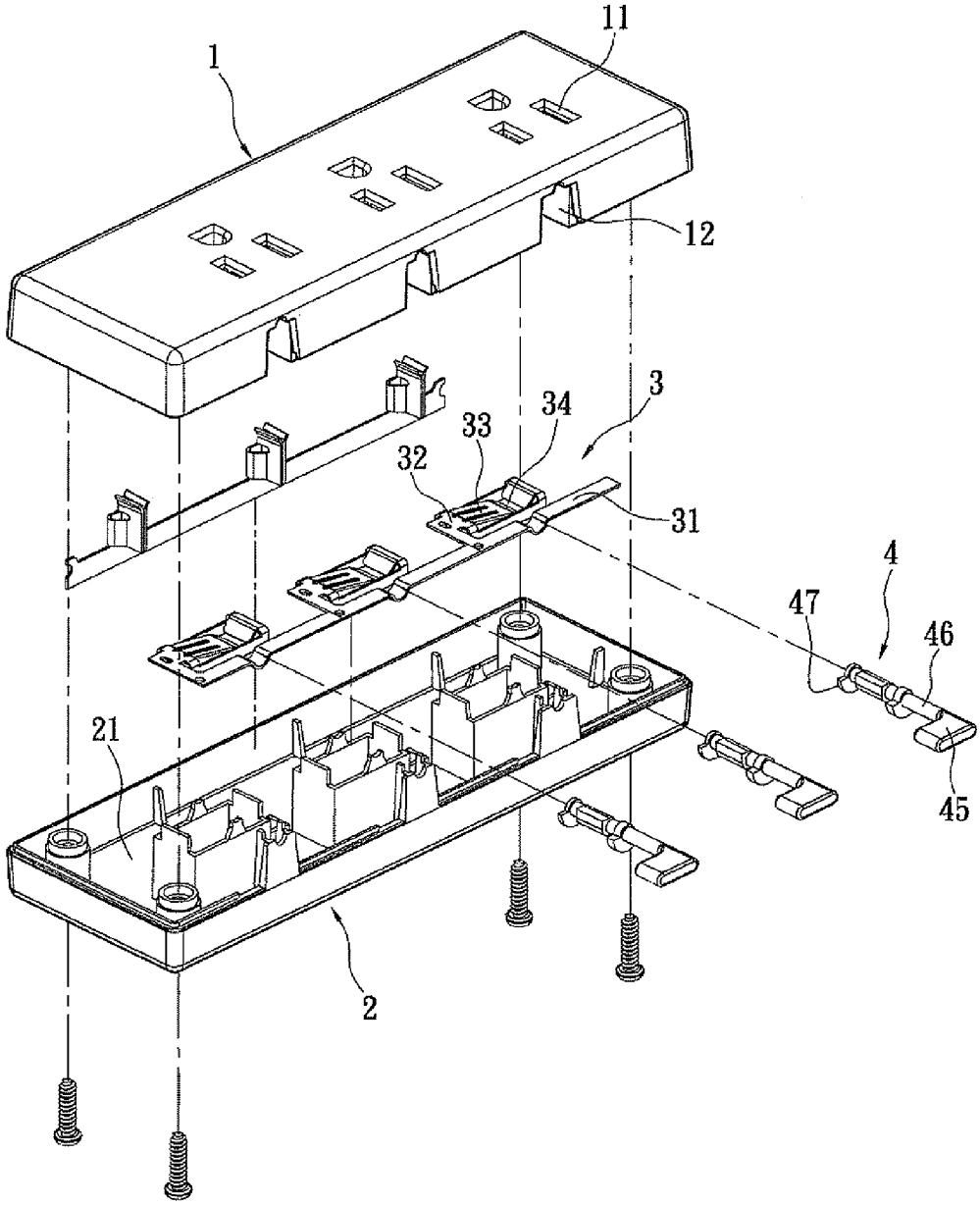
FIG. 8 is an exploded perspective view showing a third embodiment of the socket with a plug retention structure according to the present invention.
Figure 9:
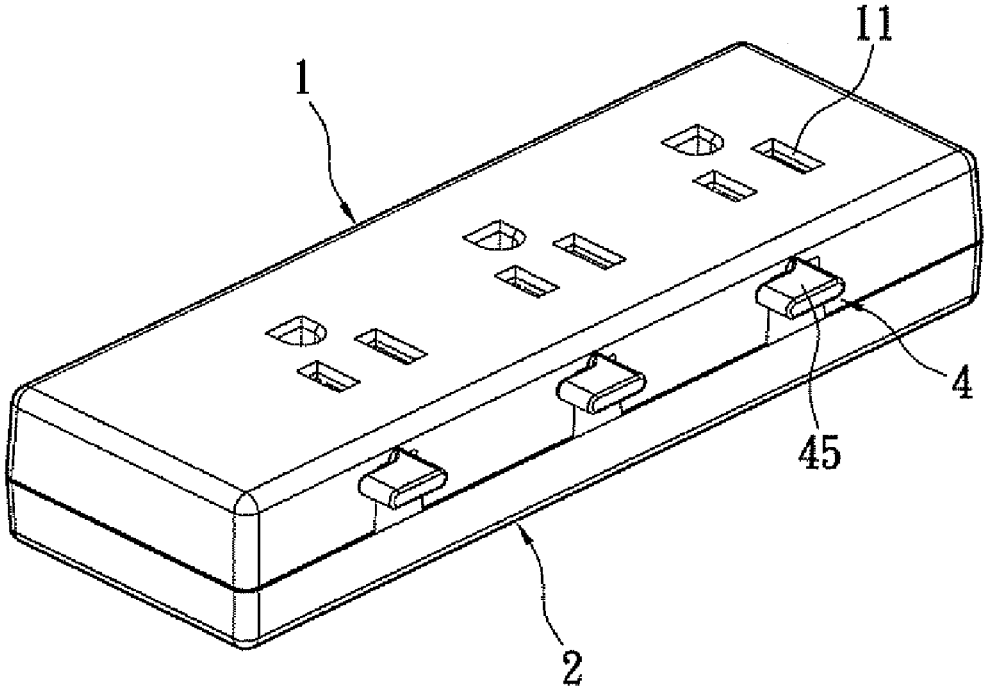
FIG. 9 is a transverse cross-sectional view showing the third embodiment of the socket with a plug retention structure according to the present invention with a plug locked status.
Figure 10:
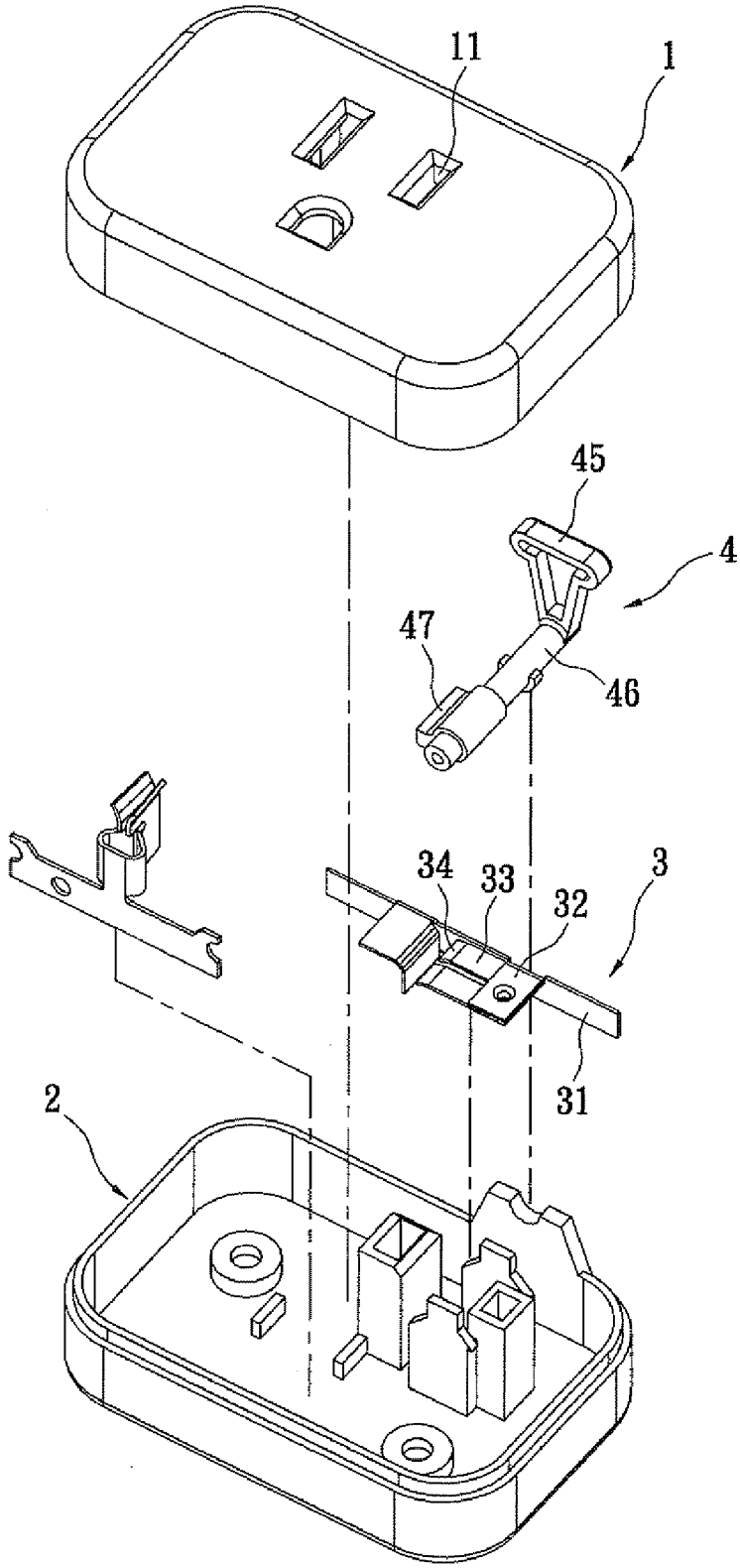
FIG. 10 is an exploded perspective view showing a fourth embodiment of the socket with a plug retention structure according to the present invention.
Figure 11:
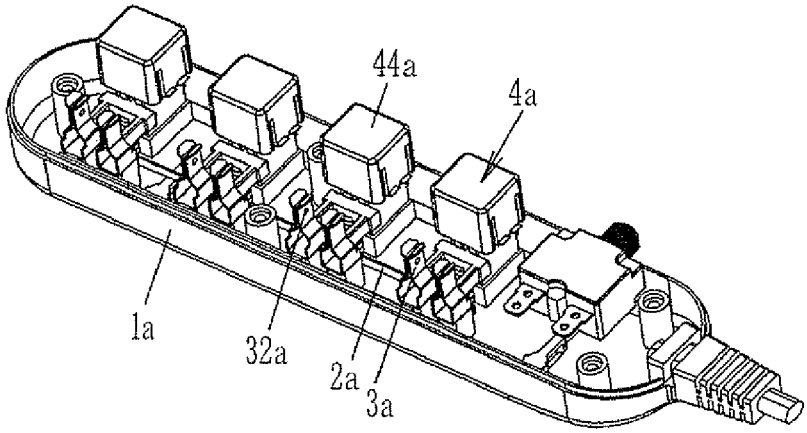
FIG. 11 PRIOR ART
FIG. 11 is a schematic diagram showing a socket with a plug retention structure according to a prior art.
Figure 12:
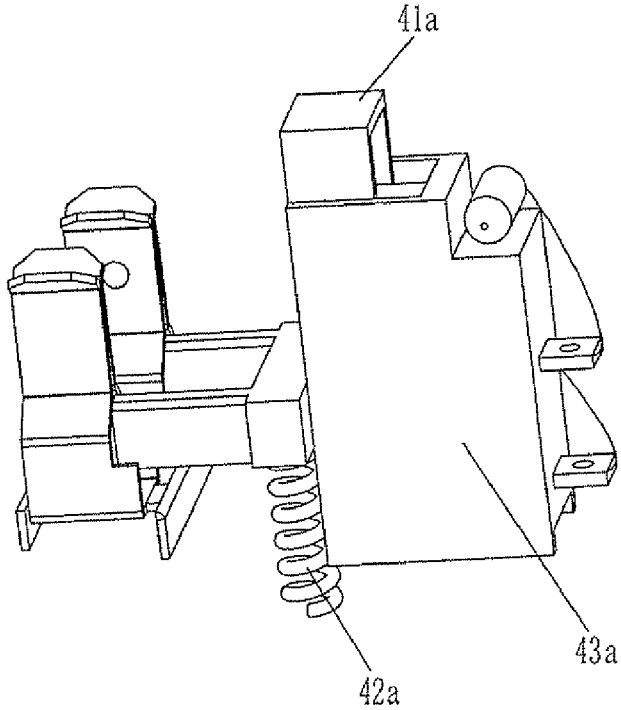
FIG. 12 PRIOR ART
FIG. 12 is a schematic diagram showing a clip control switch of the socket shown in FIG. 11.

Please refer to FIGS. 8, 9 and 10. The control unit 4 comprises a handle 45, a linkage rod 46, and a linkage block 47. The handle 45 is connected to one end of the linkage rod 46. The linkage block 47 is a cam located at a predetermined location on the linkage rod 46. The handle 45, the linkage rod 46, and the linkage block 47 are placed within the accommodating space 21 associated with the upper housing 1 and are configured to be rotating within the accommodating space 21. The handle 45 protrudes from the upper housing 1, allowing the users to turn the handle. The linkage block 47 is located above the flexible plate 33 of the flexible pieces 3. When the plug is to be removed from the socket, the users turns the handle 45 of the control unit 4 so as to make the linkage rod 6 to drive the linkage block 47. As a result, the linkage block 47 rotates to press the flexible plates 33 of the flexible pieces 3, enabling the abutting portions 34 on one ends of the two flexible plates 33 to depart from the two insertion pieces 61 of the plug 6 in order to unlock the plug.

Since the flexible pieces 3 of the present invention are made of metal, the flexible pieces 3 may allow the insertion pieces 61 to be inserted smoothly in a normal while the flexible plates 33 may provide a resistance against a detachment of the insertion pieces 61 from the insertion holes 11. Therefore, the plug 6 could be in secured engagement with the socket. Thus, the socket according to the present invention requires no locking protrusions corresponding to the holes on the insertion pieces of the plug, simplifying the structure of the flexible pieces 3 and reducing the cost for manufacturing the same. So long as the two insertion pieces 61 of the plug 6 are brought into contact with the abutting portions 34 of the flexible pieces 3, the plug 6 can be locked.

Further, in one implementation the present invention socket may include only one set of the flexible pieces 3. The abutting portion 34 of the flexible pieces 3 may correspond to one of the two insertion holes 11, so that the abutting portion 34 of the flexible pieces 3 may also abut the single insertion piece of the plug to achieve the goal of locking the plug.

What is disclosed above only the specification and the drawings of the preferred embodiment of the present invention and it is therefore not intended that the present invention be limited to the particular embodiment disclosed. Various equivalent changes, alternations, or modifications based on the claims of present invention are all consequently viewed as being embraced by the scope of the present invention. The full scope if this invention is fully described only by the following claims.

What is claimed is:

1. A socket with a plug retention structure, comprising:

an upper housing with at least two insertion holes;

a lower housing located below the upper housing with an interior thereof defining an accommodating space and corresponding to the upper housing;

at least two flexible pieces placed in the accommodating space associated with the lower housing each includes a fulcrum and at least one flexible plate with one end thereof connected to the fulcrum, and the other end thereof forming an abutting portion, wherein the abutting portions correspond to the two insertion holes and the two flexible pieces are connected to connecting pieces; and a control unit movably placed in the upper housing for selectively pressing the flexible plates.

2. The socket with a plug retention structure according to claim 1, wherein the two insertion holes of the upper housing are of live and neutral polarities respectively.

3. The socket with a plug retention structure according to claim 1, wherein the control unit is implemented horizontally or vertically.

4. The socket with a plug retention structure according to claim 1, wherein the control unit comprises a button, a linkage rod connected to the button, two first linkage blocks connected to the linkage rod each having a first bevel, and two second linkage blocks located above the flexible plates of the flexible pieces, respectively, each having a second bevel, wherein the button, the linkage rod, and the two first linkage blocks are movably placed in the accommodating place associated with the upper housing having a through-hole for the button to pass through, and the second bevels of the two second linkage blocks are brought into contact with the first bevels of the two first linkage blocks.

5. The socket with a plug retention structure according to claim 1, wherein the control unit comprises a button, a linkage rod, and two first linkage blocks connected to the linkage rod wherein the button, the linkage rod, and the two first linkage blocks are placed in the accommodating space associated with the upper housing and are capable of moving in a substantially vertical fashion, the upper housing includes a through-hole for the button to pass through, and the two first linkage blocks are located above the flexible plates of the flexible pieces.

6. A socket with a plug retention structure, comprising:

an upper housing with at least two insertion holes;

a lower housing located below the upper housing with an interior thereof defining an accommodating space and corresponding to the upper housing;

a flexible piece located in the accommodating space associated with the lower housing and having a fulcrum, and at least one flexible plate partially bent downwardly and with one end thereof connected to the fulcrum and the other end thereof forming an abutting portion wherein the abutting portion of the flexible pieces corresponds to one of the two insertion holes, and the flexible pieces are connected to a connecting piece; and a control unit movably placed in the accommodating space associated with the upper housing for selectively pressing the flexible plates of the flexible pieces.

7. The socket with a plug retention structure according to claim 6, wherein the two insertion holes of the upper housing are of live and neutral polarities respectively.

8. The socket with a plug retention structure according to claim 6, wherein the control unit comprises a handle, a linkage rod with one end connected to the handle, and a linkage block placed on the linkage rod and located above the flexible plates of the flexible pieces, wherein the handle, the linkage rod, and the linkage block are capable of rotating within the accommodating space associated with the upper housing.

* * * * *